US006551072B2

(12) United States Patent
Ota et al.

(10) Patent No.: US 6,551,072 B2
(45) Date of Patent: Apr. 22, 2003

(54) VARIABLE DISPLACEMENT COMPRESSORS

(75) Inventors: Masaki Ota, Kariya (JP); Ken Suitou, Kariya (JP); Taku Adaniya, Kariya (JP); Ryo Matsubara, Kariya (JP); Hirotaka Kurakake, Kariya (JP); Hiroyuki Yoshida, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/828,264

(22) Filed: Apr. 6, 2001

(65) Prior Publication Data

US 2002/0025258 A1 Feb. 28, 2002

(30) Foreign Application Priority Data

Apr. 7, 2000 (JP) ..... 2000-106777

(51) Int. Cl.[7] ..... F04B 1/26
(52) U.S. Cl. ..... 417/222.2; 417/270; 417/313
(58) Field of Search ..... 417/222.2, 269, 417/270, 313; 92/71; 184/6.17

(56) References Cited

U.S. PATENT DOCUMENTS 4,702,677 A * 10/1987 Takenaka et al. ..... 417/222
5,603,610 A * 2/1997 Kawaguchi et al. ..... 417/222.2
5,616,008 A * 4/1997 Yokono et al. ..... 417/222.2
5,624,240 A * 4/1997 Kawaguchi et al. ..... 417/222.2
6,015,269 A 1/2000 Ota et al. ..... 417/222.2
6,099,276 A * 8/2000 Taguchi ..... 417/569
6,174,140 B1 * 1/2001 Ota et al. ..... 417/222.2
6,203,284 B1 * 3/2001 Kawaguchi et al. ..... 417/222.2
6,206,648 B1 * 3/2001 Kimura et al. ..... 417/222.2
6,217,291 B1 * 4/2001 Ota et al. ..... 417/222.2

FOREIGN PATENT DOCUMENTS

JP 11-324910 11/1999 ..... F04B/27/14

* cited by examiner

*Primary Examiner*—Cheryl J. Tyler
*Assistant Examiner*—Han L. Liu
(74) *Attorney, Agent, or Firm*—Morgan & Finnegan, LLP

(57) ABSTRACT

Compressor has a driving unit. The driving unit is provided within a crank chamber and decreases the discharge capacity when a control valve opens a control passage to increase the pressure within the crank chamber. The throttle passage delivers oil with the compressed refrigerant to the crank chamber regardless of whether the control valve has opened or closed the control passage. Because the throttle passage may continuously deliver the oil to the crank chamber even when the control valve closes the control passage, the mechanical elements within the crank chamber can be reliably and sufficiently lubricated and the crank chamber is prevented from being in an insufficiently lubricated state.

16 Claims, 4 Drawing Sheets

VARIABLE DISPLACEMENT COMPRESSORS

BACKGROUND OF THE INVENTION

1. Field of the Invention

The present invention relates to variable displacement compressors and particularly to compressors capable of sufficiently returning the lubricant oil to lubricate the mechanical parts of the compressor.

2. Description of the Related Art

As one type of known compressors, a variable displacement compressor is disclosed in U.S. Pat. No. 6,010,312 and includes pistons and a swash plate. Each piston is reciprocally inserted within a compressor cylinder bore and an end portion of each piston is coupled to a peripheral portion of the swash plate. The swash plate is inclinably coupled to a drive shaft in a crank chamber. The swash plate rotates together with the drive shaft. The compressor output discharge capacity can be changed by changing the piston stroke. The piston stroke can be changed in relation to an inclination angle of the swash plate. The inclination angle of the swash plate can change by changing the pressure within the crank chamber. When the pressure within the crank chamber increases, the inclination angle of the swash plate with respect to a plane perpendicular to the axis of the drive shaft decreases. As the result, the piston stroke decreases and the compressor output discharge capacity decreases. To the contrary, when the pressure within the crank chamber decreases, the inclination angle of the swash plate increases. As a result, the piston stroke increases and the compressor output discharge capacity increases.

The crank chamber is connected to a discharge chamber by a control passage. A control valve is provided within the control passage. When the control valve opens the control passage, high-pressure refrigerant within the discharge chamber is released into the crank chamber through the control passage and the pressure within the crank chamber increases. By increasing the pressure in the crank chamber, the inclination angle of the swash plate with respect to the plane perpendicular to the drive shaft axis decreases, the piston stroke decreases and the compressor output discharge capacity decreases.

In addition, mechanical elements in the compressor, such as bearings for the drive shaft, are necessarily lubricated by utilizing lubricant oil. Within the compressor, the oil mixes with the refrigerant and the oil is drawn and compressed together with the refrigerant. In the discharge chamber, the oil is separated by utilizing an oil separator and is delivered to the mechanical elements of the compressor. The separated oil is returned to the crank chamber through the control passage to lubricate mechanical elements in the crank chamber. However, the control valve closes the control passage during the operation of the compressor at its maximum capacity. As the result, the crank chamber can not be sufficiently lubricated when the compressor is operated continuously at the maximum capacity because the control valve closes the control passage to maintain the crank chamber in a low-pressure state and to provide the maximum output discharge capacity.

SUMMARY OF THE INVENTION

It is, therefore, an object of the present invention to provide a compressor that can reliably and constantly supply lubricant oil to the crank chamber.

Preferably, a variable displacement compressor includes a driving unit. The driving unit is provided within a compressor crank chamber and the compressor output discharge capacity decreases when the pressure within the crank chamber increases. Further, the compressor includes a control passage, a control valve and a throttle passage. The control passage releases the refrigerant from the discharge pressure area into the crank chamber. The control valve is provided within the control passage and opens or closes the control passage. When the control valve opens the control passage, the refrigerant is released from the discharge port to the crank chamber to increase the pressure within the crank chamber, thereby decreasing the compressor output discharge capacity.

The throttle passage delivers oil within the compressed refrigerant to the crank chamber regardless of whether the control valve has opened or closed the control passage. Because the throttle passage continuously delivers oil to the crank chamber, even when the control passage has been closed by the control valve, the moving mechanical elements within the crank chamber can be reliably and sufficiently lubricated and the crank chamber is prevented from being insufficiently lubricated.

Other objects, features and advantages of the present invention will be readily understood after reading the following detailed description together with the accompanying drawings and the claims.

DETAILED DESCRIPTION OF THE INVENTION

Figure 1:
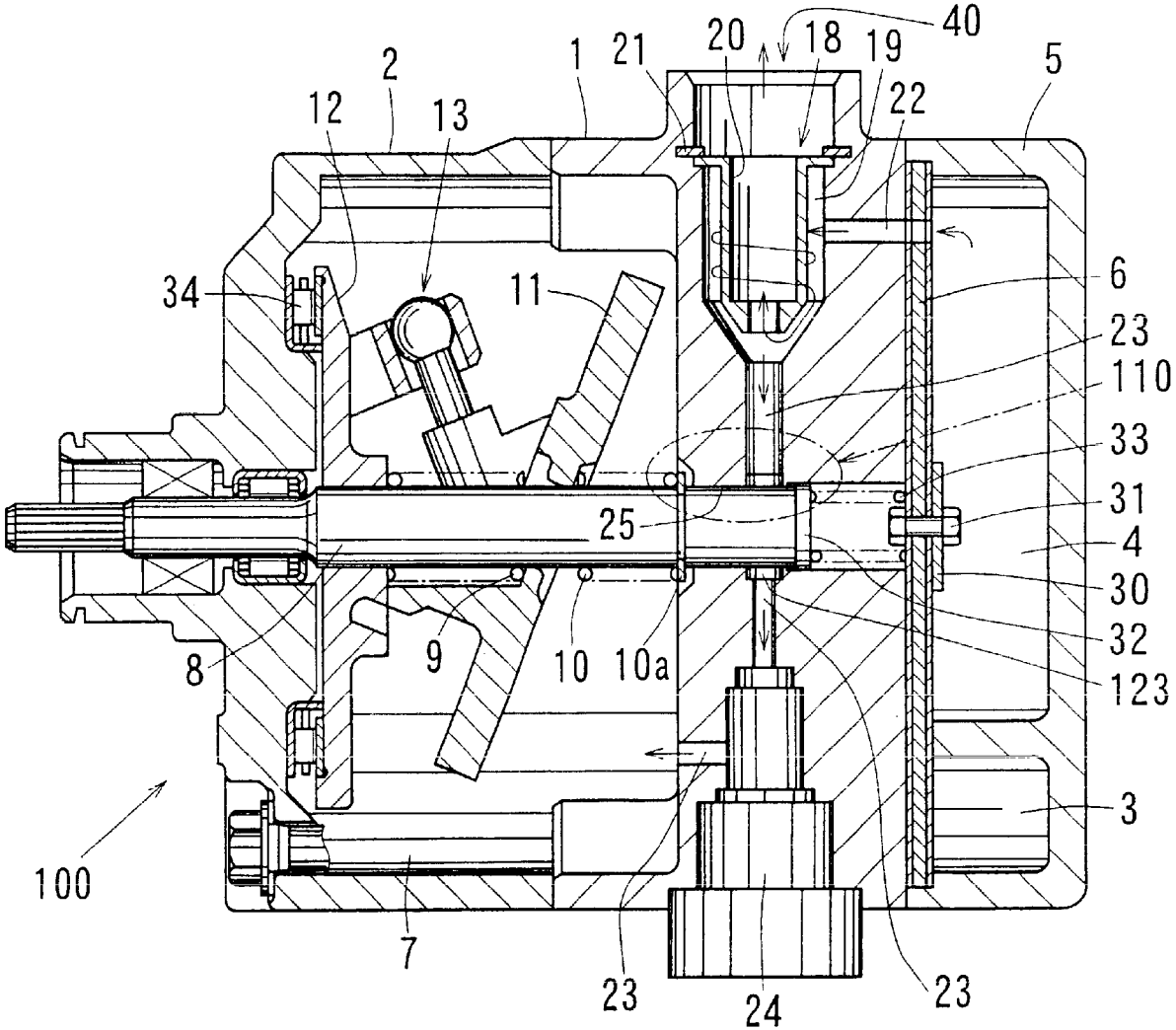
FIG. 1 shows a variable displacement compressor according to a first embodiment.

Preferably, a compressor may have an inlet port that may draw refrigerant into the compressor, an outlet port that may discharge compressed refrigerant, and a driving unit that is provided within a crank chamber. The driving unit may decrease the compressor output discharge capacity when the pressure within the crank chamber increases. To the contrary, the driving unit may increase the output discharge capacity when the pressure within the crank chamber decreases. To change the pressure within the crank chamber, the compressor may include a control passage and a control valve. The control passage may communicate with the discharge pressure area including the outlet port via the crank chamber. The control valve may be provided within the control passage to open and to close the control passage. When the control valve opens the control passage, high-pressure refrigerant is released from the discharge pressure area to the crank chamber through the opened control passage. By releasing the high-pressure refrigerant from the discharge pressure area into the crank chamber, the pressure within the crank chamber may rapidly increase and the driving unit may rapidly decrease the compressor output discharge capacity.

Further, the compressor may include a throttle passage. The throttle passage may deliver oil within the compressed refrigerant to the crank chamber. The throttle passage may deliver the oil regardless of whether the control valve is opened or closed. In other words, the throttle passage may deliver the oil to the crank chamber even when the control valve closes the control passage.

When the compressor is operated to decrease the output discharge capacity, the control valve opens the control passage. The oil may be delivered to the crank chamber through both the throttle passage and the control passage. On the other hand, when the compressor is operated at the maximum discharge capacity, the control valve closes the control passage to prevent the discharged refrigerant from being released into the crank chamber. Even in such a state, the oil may be delivered to the crank chamber through the throttle passage. Therefore, the compressor can prevent the crank chamber from being in an insufficiently lubricated state, because the throttle passage can deliver the oil to the crank chamber even when the control passage is closed. Further, because the passage is throttled, high-pressure refrigerant can be prevented from being released too much into the crank chamber through the throttle passage and as the result, the loss of the efficiency can be minimized.

The compressor may draw and compress the refrigerant that includes oil. That is, the throttle passage delivers the oil together with the refrigerant into the crank chamber. The oil delivered to the crank chamber may be utilized to lubricate the mechanical elements of the crank chamber. Otherwise, the oil may, before delivery, be separated from the refrigerant at the discharge pressure area and may be delivered through the throttle passage. In such a case, the oil may be separated from the refrigerant by utilizing an oil separator that is provided within the discharge pressure area.

The throttle passage may preferably be defined by a radial clearance between a cylinder block and the drive shaft that rotatably penetrates the cylinder block. Also, the throttle passage may preferably be defined by a radial clearance between the cylinder bore and the piston. In each example, the surfaces of the elements can be lubricated while the throttle passage defined by the clearance may deliver the oil into the crank chamber to lubricate the crank chamber. Further, in each example, because the narrow clearance between the two elements can directly function as the throttle passage, other structures are not required to form a throttle passage and thus, the structure of the compressor can be simplified. The clearance between the cylinder block and the drive shaft or the clearance between the cylinder bore and the piston is one of the features that corresponds to means for continuously delivering the oil within the compressed refrigerant to the crank chamber regardless of the control valve opening or closing the control passage.

Each of the additional features and method steps disclosed above and below may be utilized separately or in conjunction with other features and method steps to provide improved compressors and air conditioning systems and methods for designing and using such compressors and air conditioning systems. Representative examples of the present invention, which examples utilize many of these additional features and method steps in conjunction, will now be described in detail with reference to the drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention, which detailed description will now be given with reference to the accompanying drawings.

DETAILED REPRESENTATIVE EMBODIMENT

Referring to FIG. 1, a compressor 100 includes a cylinder block 1, a front housing 2 and a rear housing 5. The front housing 2 is coupled to a front end of the cylinder block 1. The rear housing 5 is coupled to a rear end of the cylinder block 1 through a valve plate 6, and defines a suction chamber 3 and a discharge chamber 4. The front housing 2, the rear housing 5 and the cylinder block 1 form a compressor housing. Further, the compressor 100 includes a crank chamber 7 defined within the front housing 2. An end portion of a drive shaft 8 is inserted into the crank chamber 7 to penetrate both the front housing 2 and the cylinder block 1. The other end portion of the drive shaft 8 is connected to the drive source for the compressor 100.

In the crank chamber 7, a swash plate 11 is slidably and rotatably coupled to the drive shaft 8. To couple the swash plate 11 to the drive shaft 8, a rotor 12 is provided on the drive shaft 8 and the rotor 12 is coupled to the swash plate 11 by means of a hinge structure 13. Further, by means of balance springs 9, 10, the swash plate 11 is maintained at a small inclined angle, for example at S degrees, when the compressor is not in operation. The balance spring 9 at the left side of the swash plate 11 is received by the rotor 12 and the balance spring 10 at the right side of the swash plate 11 is received by a stopper ring 10*a*. Moreover, a thrust race 32 and a spring 33 are inserted in the drive shaft receiving portion of the cylinder block 1. The thrust race 32 and the spring 33 bias the end portion of the drive shaft 8 in the axial direction of the drive shaft 8 (left side in FIG. 1 and 2).

The swash plate 11 rotates together with the drive shaft 8. The inclination angle of the swash plate 11 with respect to a plane perpendicular to the axis of rotation of the drive shaft 8 can change. The hinge structure 13 allows swash plate 11 to rotate at various inclination angles.

Figure 2:
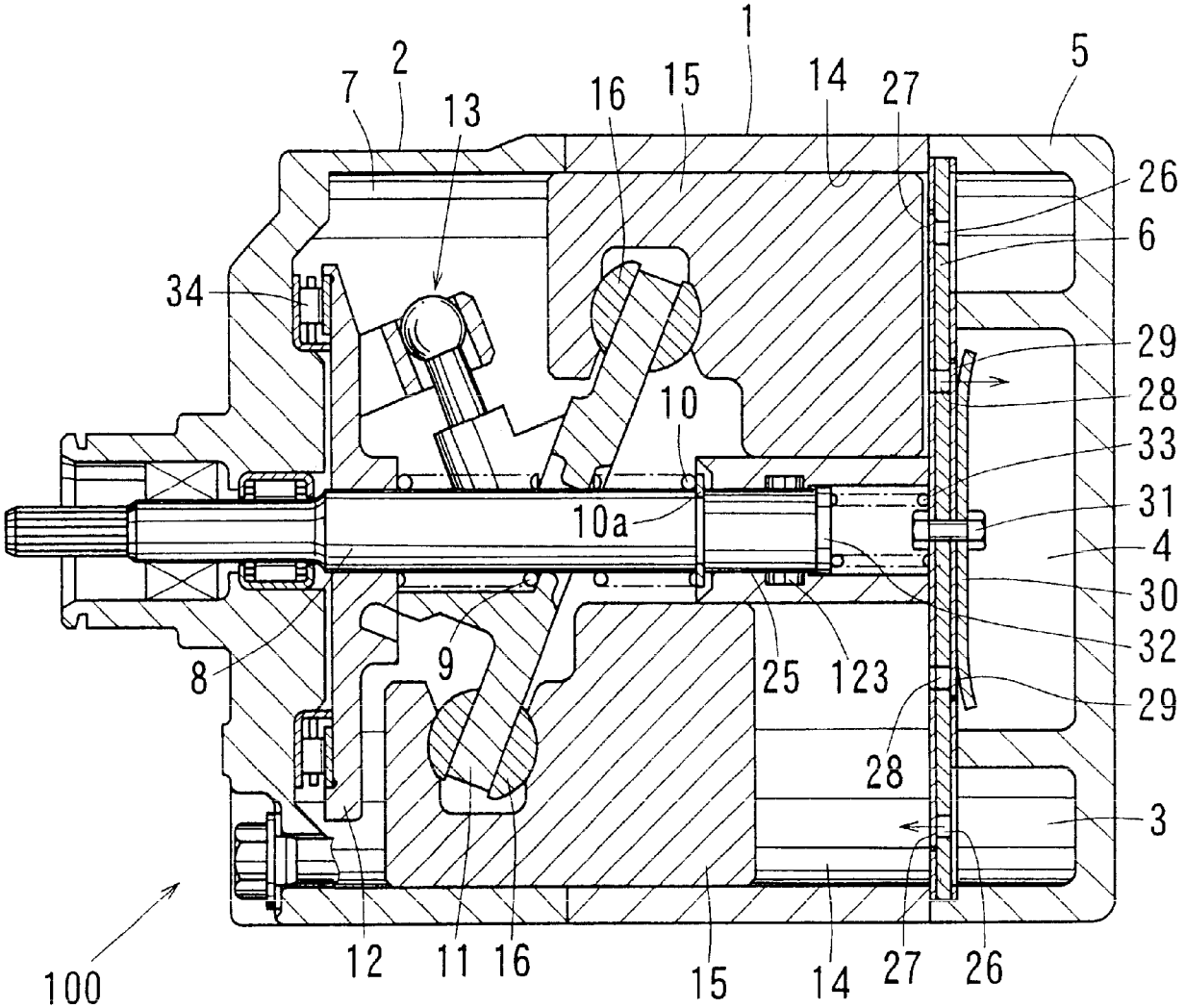
FIG. 2 shows a structure shown from a different angle of the first representative compressor.

As shown in FIG. 2, the peripheral edge portion of the swash plate 11 is connected to the base portions of the pistons 15 by means of movable shoes 16. Six pistons 15 in total are disposed equiangularly around the drive shaft 8 (however, only two pistons are shown in FIG. 2 for purpose of illustration) and may reciprocate within respective six cylinder bores 14. The back side of the pistons 15 are extended to the crank chamber 7.

When the swash plate 11 rotates together with the drive shaft 8 while being inclined as shown in FIG. 2, the rotation of the swash plate 11 is converted to a reciprocating movement of the pistons 15 through shoes 16.

As particularly shown in FIG. 2, suction ports 26 and discharge ports 28 are provided within the valve plate 6 between the cylinder block 1 and the rear housing 5 to correspond to respective cylinder bores 14. Suction valves 27 are positioned to correspond to the respective suction port 26 and discharge valves 29 are positioned to correspond to the respective discharge port 28. A retainer plate 30 is fixed on the valve plate 6 by a pin 31 to regulate the degree of opening of the discharge valves 29.

When the piston 15 moves to the left in FIG. 2, as a result of rotation of the swash plate 11, refrigerant is introduced from the suction chamber 3 as a suction pressure area through the suction port 26 and suction valve 27 into the cylinder bore 14. When the piston 15 moves to the right in FIG. 2, as a result of further rotation of the swash plate 11, the refrigerant is compressed into a high-pressure state and discharged through the discharge port 28 and the discharge valve 29 to the discharge chamber 4 as a discharge pressure area.

In FIG. 2, the upper side piston is at the top dead center position (at the end of the discharge stroke), and the lower side piston is at the bottom dead center position (at the end of the suction stroke.) The output discharge capacity of the compressor 100 is determined by the stroke length of the piston 15, which is determined by the degree of inclination angle of the swash plate 11. That is, the larger the swash plate 11 is inclined with respect to the plane perpendicular to the drive shaft 8, the longer the stroke length of the piston 15 will be. As the stroke length increases, the output discharge capacity of the compressor 101 also increases.

The inclination angle of the swash plate 11 is determined by the difference in pressure on the opposite sides of the piston 15, i.e., the pressure difference between the crank chamber pressure and the cylinder bore pressure. Increasing or decreasing the crank chamber pressure can adjust this pressure difference.

Although it is not particularly shown in figures, the crank chamber 7 is connected to the suction chamber 3 by a bleed passage.

In order to decrease the compressor output discharge capacity, the high-pressure refrigerant is released from the discharge chamber 4 into the crank chamber 7. Due to resulting increase in the pressure within the crank chamber 7, the swash plate 11 reduces the inclination angle with respect to the plane perpendicular to the axis of the drive shaft 8 and the stroke length of the piston 15 decreases. Therefore, the output discharge capacity will also decrease. On the other hand, in order to increase the output discharge capacity, the refrigerant in the discharge chamber 4 is prevented from being released into the crank chamber 7. The refrigerant in the crank chamber 7 is released to the suction chamber 3 through the bleed passage not shown. As the result, the pressure within the crank chamber 7 will gradually decrease, the swash plate 11 will increase its inclination angle and the stroke length of the piston 15 will increase. In this case, the output discharge capacity will increase.

As it is shown in FIG. 1, the compressor 100 further includes a refrigerant introducing passage 22 that is connected with an outlet 40, a control passage 23, a control valve 24, an oil separator 18.

The refrigerant compressed by the piston 15 includes oil in the form of mist for lubricating the mechanical elements in the compressor. The oil included within the refrigerant is separated by the oil separator 18. According to FIG. 1, the oil separator 18 has an oil separation chamber 19 and an oil separation sleeve 20. The oil separation sleeve 20 is positioned within the oil separation chamber 19 coaxially by means of its flange portion and a stopper ring 21. The oil separation chamber 19 is provided within the cylinder block 1 between the cylinder bores 14 and may communicate with the discharge chamber 4 through the refrigerant introducing passage 22. The refrigerant introducing passage 22 connects to the oil separation chamber 19 approximately in the tangential direction of the oil separation chamber 19. The refrigerant introduced into the oil separation chamber 19 will swirl around the outer wall of the oil separation sleeve 20 and flow through the inside of the sleeve 20 to the outlet 40 to the outside of the compressor 100. At this time, the oil included within the refrigerant is separated from the refrigerant by the centrifugal force that is exerted on the refrigerant when the refrigerant including the oil spirally swirls along the outer wall of thc oil separation sleeve 20 and collides with the inner wall of the oil separation chamber 19. The oil separated from the refrigerant also descend to a bottom portion of the oil separation chamber 19. Thus, the refrigerant that does not include the oil is discharged through the outlet 40 to the outside of the compressor 100, such as a condenser in the outer refrigerant circuit.

The oil separation chamber 19 communicates with the crank chamber 7 through the control passage 23 which is formed in the cylinder block 1 and introduces discharge pressure to the crank chamber 7. The control passage 23 is opened and closed by the control valve 24. The control valve 24 is provided within the cylinder block 1. For example, although it is not particularly shown in the drawings, the control valve 24 may include a valve body that opens and closes the control passage 23 and a solenoid that controls the valve body. The control passage 23 can be opened and closed by energizing and not energizing the solenoid.

Figure 3:
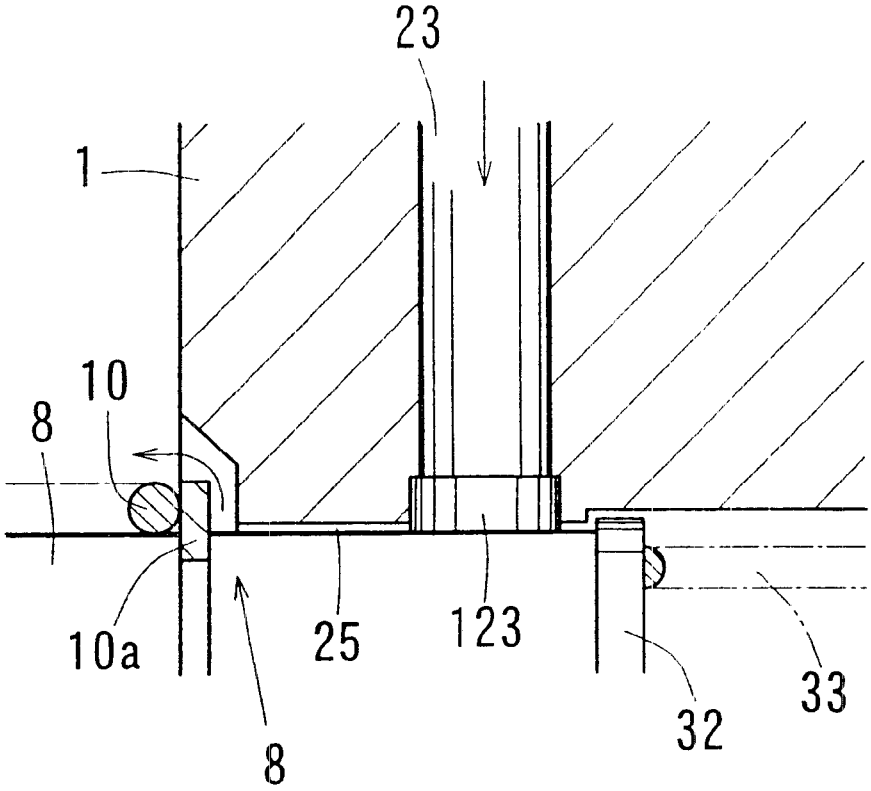
FIG. 3 shows an enlarged view of portion 1 shown in FIG. 1

The control passage 23 further includes an annular passage 123 on the surface facing the drive shaft 8 within the cylinder block 1. The annular passage 123 is provided on the upstream side of the control valve 24 and may communicate with the crank chamber 7 at all times via a throttle passage 25. As shown in FIG. 3, the throttle passage 25 is defined by a radial clearance between the cylinder block 1 and the drive shaft 8. Thus, the discharge chamber 4 communicates with the crank chamber 7 via a route that includes the control valve 24 and via a route that includes the throttle passage 25.

During operation of the compressor 100, the control valve 24 closes the control passage 23 in order to increase the compressor output discharge capacity. The refrigerant in the discharge chamber 4 is not released into the crank chamber 7 and the refrigerant in the crank chamber 7 is gradually released into the suction chamber via the bleed passage. The pressure within the crank chamber 7 will gradually decrease so as to increase the inclination angle of the swash plate 11 and to increase the compressor output discharge capacity. In this state, the oil separated by the oil separator 18 is not delivered to the crank chamber 7 via the control passage 23, because the control valve 24 closes the control passage 23. However, the throttle passage 25 communicates via the annular passage 123 with the crank chamber 7 at all times and therefore, the oil within the oil separator 18 may be delivered to the crank chamber 7 via the throttle passage 25. To the contrary, when the control valve 24 opens the control passage 23, high-pressure refrigerant within the discharge chamber 4 is released into the crank chamber 7 via the control passage 23. As the result, the pressure within the crank chamber 7 increases so as to decrease the output discharge capacity. At this time, the oil separated by the oil separator 18 is delivered to the crank chamber 7 via the open control passage 23 and the throttle passage 25.

As explained above, the compressor 100 can change the output discharge capacity by changing the pressure within the crank chamber 7. Further, the pressure within the crank chamber 7 can be controlled by introducing the discharge pressure into the crank chamber 7 via the control passage 23 that may be opened and closed by the control valve 24. Therefore, when the compressor 100 is operated at maximum capacity, the control valve 24 closes the control passage 23. Consequently, the oil within the oil separator 18 will not be delivered to the crank chamber 7 via the control passage 23, which has been closed by the control valve 24. On the other hand, because the throttle passage 25 communicates via the control passage 23 with the crank chamber 7 even when the control valve 24 closes the control passage 23, the oil separated by the oil separator 18 can be delivered to the crank chamber 7 via the throttle passage 25. To the contrary, when the control valve 24 opens the control passage 23, the oil within the oil separator 18 can be delivered to the crank chamber 7 via the control passage 23 that has been opened by the control valve 24 and via the throttle passage 25. Therefore, the oil can be rapidly delivered to the crank chamber 7 by utilizing two routes.

In the compressor 100, the throttle passage 25 delivers the oil separated from the discharged refrigerant into the crank chamber 7 even when the control valve 24 closes the control passage 23. Therefore, the compressor 100 can prevent the crank chamber 7 from being insufficiently lubricated. As the result, even when the compressor 100 is operated for a relatively long time at maximum capacity, the compressor 100 can sufficiently lubricate the moving mechanical elements within the crank chamber 7, such as the swash plate 11, the contacting surfaces between the shoe 16 and the piston 15, the hinge structure 13, and the contacting surfaces between the swash plate 11 and the drive shaft 8.

Further, in the compressor 100, the throttle passage 25 is defined by the clearance between the cylinder block 1 and the drive shaft 8. Therefore, a specialized passage is not required to define the throttle passage. Further, the contacting surface between the cylinder block 1 and the drive shaft 8 can also be lubricated when the oil is delivered to the crank chamber 7 through the throttle passage 25.

Figure 4:
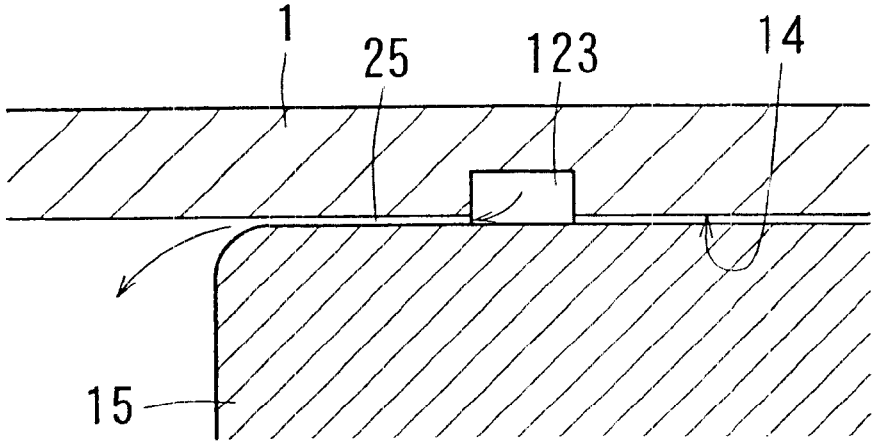
FIG. 4 shows a detailed structure of a modification of the throttle passage of the compressor.

FIG. 4 shows a modification of the throttle passage 25 in the compressor 100. According to FIG. 4, the throttle passage 25, which couples the oil separator 18 with the crank chamber 7, is defined by a clearance between the piston 15 and the cylinder bore 14. In this modification, an annular passage 123 is formed around the inner surface of the cylinder bore 14. The contacting surface between the cylinder bore 14 and the piston 15 can also be lubricated when the oil within the oil separator 18 is delivered to the crank chamber 7 through the throttle passage 25.

Figure 5:
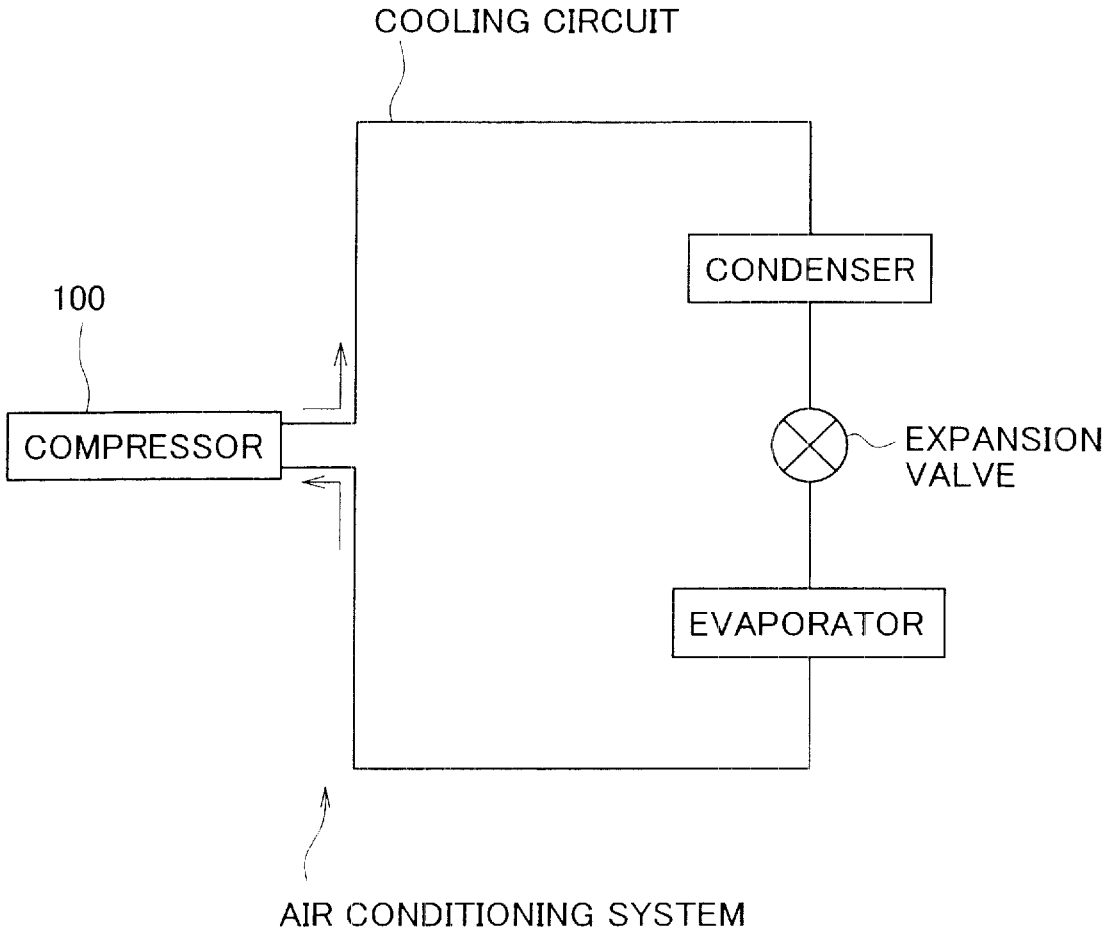
FIG. 5 shows an air conditioning system that includes one of the compressors.

Further, as one example, an air conditioning system for an automobile that utilizes the compressor 100 is shown in FIG. 5, wherein the refrigerant to circulate in the air conditioning system is compressed by the compressor 100.

As another modification of the throttle passage, a passage that opens within the cylinder block 1 other than the clearance between the drive shaft 8 and the cylinder block 1 or the clearance between the cylinder block 1 and the piston 15 may define the throttle passage.

What is claimed is:

1. A variable displacement compressor comprising:

a driving unit provided within a crank chamber, the driving unit changing compressor output discharge capacity in accordance with pressure within the crank chamber, a control passage releasing compressed refrigerant from a discharge pressure area into the crank chamber, a control valve disposed within the control passage, the control valve opening and closing the control passage to control the pressure within the crank chamber, an oil separator disposed within the control passage at an upstream side of the control valve, the oil separator separating the oil from the compressed refrigerant, and a throttle passage adapted to deliver the oil separated from the compressed refrigerant to the crank chamber regardless of whether the control valve has opened or closed the control passage, wherein the throttle passage branches from a portion of the control passage that extends between the oil separator and the control valve.

2. A compressor according to claim 1, wherein the driving unit further comprises:

a swash plate connected to a drive shaft disposed within the crank chamber, the swash plate rotating together with the drive shaft at an inclination angle with respect to a plane perpendicular to the drive shaft, and a piston disposed in a cylinder bore, the piston being connected to a peripheral edge of the swash plate, the piston reciprocating within the cylinder bore to compress the refrigerant in response to rotation of the swash plate within the crank chamber.

3. A compressor according to claim 2, wherein the throttle passage is defined by a clearance between a cylinder block and the drive shaft that rotatably penetrates the cylinder block.

4. A compressor according to claim 2, wherein the throttle passage is defined by a clearance between the cylinder bore and the piston.

5. A compressor according to claim 1, wherein the oil is delivered to the crank chamber to lubricate moving mechanical elements within the crank chamber.

6. A compressor according to claim 1, wherein the oil is delivered to the crank chamber through the throttle passage when the compressor is operated at maximum capacity and the oil is delivered to the crank chamber through both the throttle passage and the control passage when the control valve has opened the control passage.

7. An air conditioning system for an automobile comprising a cooling circuit in communication with the compressor according to claim 1, wherein the refrigerant that circulates within the cooling circuit is compressed by the compressor according to claim 1.

8. A method for lubricating the compressor according to claim 1 comprising:

delivering the oil to the crank chamber through the throttle passage when the compressor is operated at maximum capacity and delivering the oil to the crank chamber through both the throttle passage and the control passage when the control valve has opened the control passage.

9. A variable displacement compressor comprising:

a driving unit provided within a crank chamber, the driving unit changing compressor output discharge capacity in accordance with pressure within the crank chamber, a control passage releasing compressed refrigerant from a discharge pressure area into the crank chamber, a control valve disposed within the control passage, the control valve opening and closing the control passage to control the pressure within the crank chamber, an oil separator disposed within the control passage at an upstream side of the control valve, the oil separator separating oil from the compressed refrigerant, and means for delivering the oil separated from the compressed refrigerant to the crank chamber regardless of whether the control valve has opened or closed the control passage, wherein the means for delivering oil branches from a portion of the control passage that extends between the oil separator and the control valve.

10. A compressor according to claim 9, wherein the means for delivering oil is defined by a clearance between a cylinder block and a drive shaft that rotatably penetrates the cylinder block.

11. A compressor according to claim 9, wherein the driving unit comprises a piston movably disposed within a cylinder bore and the means for delivering oil is defined by a clearance between the cylinder bore and the piston.

12. A variable displacement compressor comprising:

a driving unit provided within a crank chamber, the driving unit changing compressor output discharge capacity in accordance with pressure within the crank chamber, a control passage releasing compressed refrigerant from a discharge pressure area into the crank chamber, a control valve disposed within the control passage, the control valve opening and closing the control passage to control the pressure within the crank chamber, an oil separator disposed within the control passage at an upstream side of the control valve, the oil separator separating oil from the compressed refrigerant, and means for delivering oil separated from the compressed refrigerant to the crank chamber regardless of whether the control valve has opened or closed the control passage when the compressor is operated at maximum capacity, wherein the means for delivering oil communicates with a portion of the control passage that extends between the oil separator and the control valve.

13. A compressor comprising:

a drive shaft rotatably disposed within a crank chamber, a swash plate pivotably coupled to the drive shaft and rotating together with the drive shaft at an inclination angle with respect to a plane perpendicular to the drive shaft, a piston movably disposed within a cylinder bore, the piston being connected to a peripheral edge of the swash plate and being arranged to reciprocate within the cylinder bore so as to compress refrigerant in response to rotation of the swash plate within the crank chamber, wherein compressor output discharge capacity changes in accordance with pressure changes within the crank chamber, a control passage arranged and constructed to release compressed refrigerant from a discharge pressure area into the crank chamber, a control valve disposed within the control passage, the control valve opening and closing the control passage so as to control the pressure within the crank chamber, and a throttle passage defined by a clearance between the cylinder bore and the piston, the throttle passage delivering oil disposed within the compressed refrigerant to the crank chamber regardless of whether the control valve has opened or closed the control passage.

14. A compressor according to claim 13, wherein the oil is delivered to the crank chamber via only the throttle passage when the compressor is operating at maximum capacity and the oil is delivered to the crank chamber via both the throttle passage and the control passage when the control valve has opened the control passage.

15. A variable displacement compressor comprising:

a drive shaft rotatably disposed within a crank chamber, a swash plate pivotably coupled to the drive shaft and rotating together with the drive shaft at an inclination angle with respect to a plane perpendicular to the drive shaft, a piston movably disposed within a cylinder bore, the piston being connected to a peripheral edge of the swash plate and being arranged and constructed to reciprocate within the cylinder bore so as to compress refrigerant in response to rotation of the swash plate within the crank chamber, wherein compressor output discharge capacity changes in accordance with pressure changes within the crank chamber, a control passage arranged and constructed to release compressed refrigerant from a discharge pressure area into the crank chamber, a control valve disposed within the control passage, the control valve opening and closing the control passage so as to control the pressure within the crank chamber, and a clearance defined by a clearance between the cylinder bore and the piston, the clearance delivering being arranged and constructed to supply oil within the compressed refrigerant to the crank chamber regardless of whether the control valve has opened or closed the control passage.

16. A variable displacement compressor according to claim 15, wherein the oil is delivered to the crank chamber via only the clearance when the compressor is operating at maximum capacity and the oil is delivered to the crank chamber via both the clearance and the control passage when the control valve has opened the control passage.

* * * * *

UNITED STATES PATENT AND TRADEMARK OFFICE

CERTIFICATE OF CORRECTION

PATENT NO. : 6,551,072 B2
DATED : April 22, 2003
INVENTOR(S) : Masaki Ota et al.

It is certified that error appears in the above-identified patent and that said Letters Patent is hereby corrected as shown below:

Column 4,
Line 25, please delete “S degrees” and insert therefore -- 5 degrees --.

Column 9,
Line 15, please insert -- the -- after “delivering”.

Signed and Sealed this

Eighth Day of July, 2003

JAMES E. ROGAN
*Director of the United States Patent and Trademark Office*